US005509783A

United States Patent [19]

Jones

[11] Patent Number: 5,509,783

[45] Date of Patent: Apr. 23, 1996

[54] REINFORCED VANE

[75] Inventor: Ralph G. Jones, Leicester, England

[73] Assignee: Preci-Spark, Ltd., Leicester, England

[21] Appl. No.: 210,077

[22] Filed: Mar. 17, 1994

Related U.S. Application Data

[63] Continuation of Ser. No. 15,564, Feb. 9, 1993, abandoned.

[51] Int. Cl.[6] ..... F01D 9/00

[52] U.S. Cl. ..... 415/217.1; 415/209.4; 416/97 R; 416/233

[58] Field of Search ..... 415/208.1, 209.1, 415/209.4, 217.1; 416/233, 97 R

[56] References Cited

U.S. PATENT DOCUMENTS

| | | | |
|---|---|---|---|
| 2,914,300 | 11/1959 | Sayre | 415/217.1 |
| 2,994,124 | 8/1961 | Denny et al. | 415/217.1 |
| 4,976,587 | 12/1990 | Johnston et al. . | |
| 5,102,299 | 4/1992 | Frederick | 416/97 R |

FOREIGN PATENT DOCUMENTS

| | | | |
|---|---|---|---|
| 489781 | 1/1953 | Canada | 416/97 R |
| 266954 | 5/1988 | European Pat. Off. . | |
| 2559422 | 8/1985 | France . | |
| 892698 | 11/1953 | Germany . | |
| 360230 | 11/1931 | United Kingdom . | |
| 716612 | 10/1954 | United Kingdom . | |
| 1063240 | 8/1967 | United Kingdom . | |
| 1078116 | 8/1967 | United Kingdom | 416/97 R |
| 1222565 | 2/1971 | United Kingdom . | |
| 1240765 | 7/1971 | United Kingdom | 416/96 A |
| 1320539 | 6/1973 | United Kingdom | 416/229 R |
| 2154286 | 9/1985 | United Kingdom . | |
| 2254112 | 9/1992 | United Kingdom . | |
| 2254892 | 10/1992 | United Kingdom . | |

*Primary Examiner*—Edward K. Look
*Assistant Examiner*—Michael S. Lee
*Attorney, Agent, or Firm*—Frijouf, Rust & Pyle

[57] ABSTRACT

An aerofoil (10) for a turbocharger stator for a large diesel engine has a convex, upper wall (12) and a concave, lower wall (14) with a leading edge (16) and a trailing edge (18). A wiggle strip (22) extends the length of the aerofoil and is brazed to the walls to provide added strength. The inner surface of the wall (12) is reinforced by a plate (20) extending from the trailing edge to a point in the region of the maximum spacing between the walls (12, 14). The plate is a shaped reinforcement piece and gives added strength to the area of the wall (12) which is impacted by cleaning medium. It provides a localized reinforcement to the area which is prone to damage by cleaning.

11 Claims, 1 Drawing Sheet

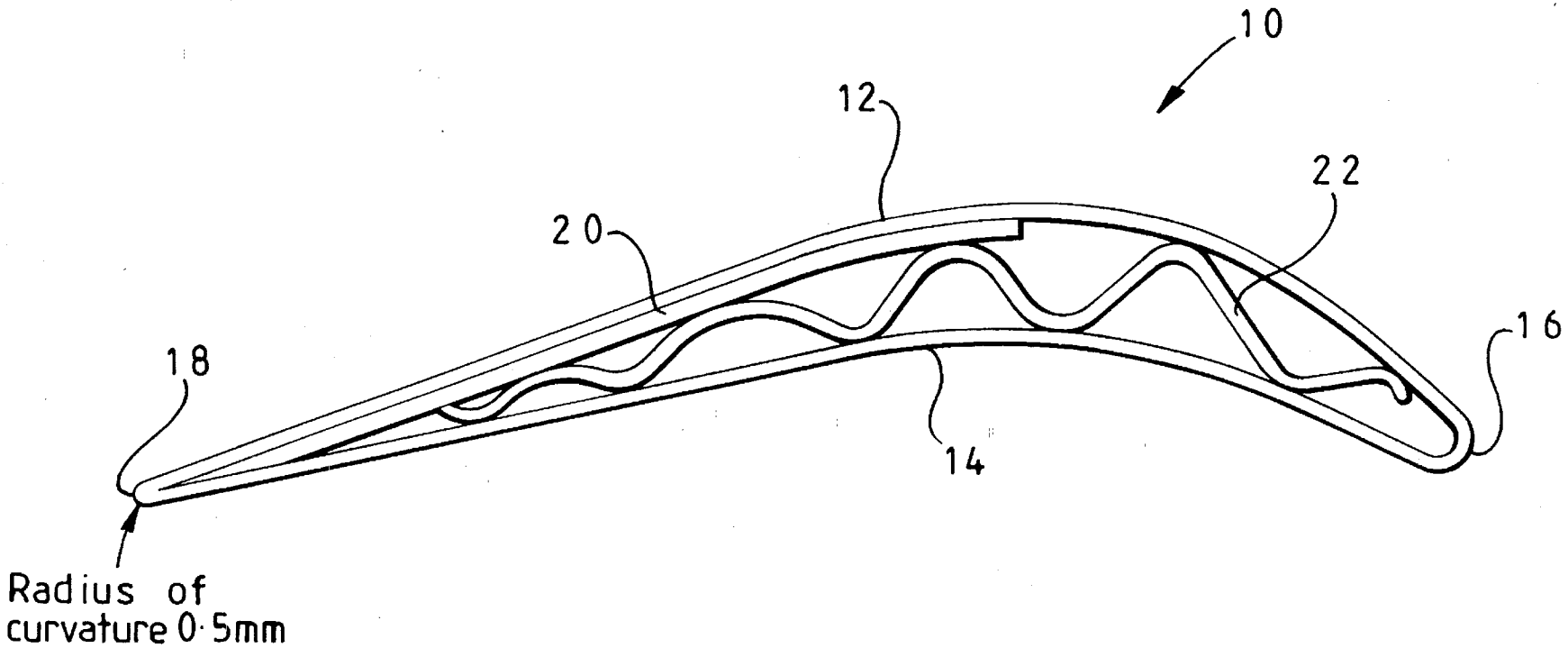
10
12
14
16
18
20
22
Radius of curvature 0·5mm

REINFORCED VANE

This application is a continuation of application Ser. No. 08/015,564 filed Feb. 9, 1993, the disclosure of which is incorporated herein by reference now abandoned.

The present invention relates to a vane for a turbocharger stator as used on large diesel engines, two-stroke and four-stroke.

Such large diesel engines in many instances use heavy fuel which gives rise to extremely dirty exhaust gases. This results in an accumulation of solid carboniferous material on the vanes of the engines, resulting in a loss of efficiency. Regular cleaning is therefore necessary in order to maintain the performance of the turbocharger and this is normally effected by introducing a hard medium into the exhaust gas upstream of the turbocharger. The impact of the medium on the internal surfaces of the turbine dislodges the impurities.

However, a disadvantage of this cleaning process is that because the exhaust gases are moving at a relatively high speed, the impact of the medium on the vanes can deform the suction surface of the vanes.

The present invention seeks to provide an improved vane for a turbine impeller.

Accordingly, the present invention provides a vane for a turbocharger stator, the vane :being of generally hollow construction with a convex wall and a concave wall meeting at a leading edge and a trailing edge of the vane; and wherein said convex wall is thickened over a portion of its inner surface extending from said trailing edge wherein the thickened portion extends from said trailing edge to a point in the region of the maximum spacing between said convex and concave walls.

A preferred form of vane according to the present invention has internal reinforcements in the form of sheet material pleated in a direction substantially parallel to the trailing and leading edges.

A vane according to the present .invention enables the use of relatively thin material for the vane walls with localised reinforcement to the area prone to damage by cleaning.

The present invention is further described hereinafter, by way of example, with reference to the accompany drawing which illustrates a preferred embodiment of vane according to the present invention.

Referring to the drawing, this is cross-section through a vane 10 in the form of an aerofoil for a turbocharger stator for a large diesel engine.

The aerofoil has a convex (upper) wall 12 and a concave (lower) wall 14, a leading edge 16 and a trailing edge 18.

The aerofoil is manufactured from a thickness of material dictated by the radius of its trailing edge. A typical example of such an aerofoil would have chordal length of 100 mm, a thickness of 12 mm to 14 mm and a trailing edge 18 radius of 0.5 mm. A wiggle strip 22 extends the whole length of the aerofoil and is brazed into position to give added strength.

The inner surface of the convex wall 12 has a reinforcing plate 20 secured to it, typically by brazing, the reinforcing plate 20 extending from the trailing edge 18 to a point in the region of maximum spacing between the convex and concave walls 12, 14.

The plate 20 is a shaped reinforcement piece and is designed to give added strength to the area impacted by cleaning medium. It extends into and fills the volume formed by the curvature of the trailing edge 18.

The invention, therefore, relates to the use of thin material for aerofoils with localized reinforcement to the area prone to damage by cleaning.

I claim:

1. A vane for a turbocharger stator, comprising:

the vane being of generally hollow construction with a convex wall and a concave wall meeting at a leading edge and a trailing edge of the vane;

said convex wall being thickened over a portion of an inner surface thereof by a reinforcing plate secured to said inner surface of said convex wall;

said convex wall and said concave wall defining a region of maximum spacing between said convex and concave walls between said leading edge and said trailing edge, of the vane; and said reinforcing plate extending from said trailing edge to a point in said region of the maximum spacing between said convex and concave walls to serve as a reinforcement to an area of the vane prone to damage during cleaning by impacting cleaning material.

2. A vane as claimed in claim 1 having internal reinforcement.

3. A vane as claimed in claim 2 wherein said internal reinforcement is formed by sheet material pleated in a direction substantially parallel to the trailing and leading edges.

4. A vane as claimed in claim 1 wherein said trailing edge has a radius of substantially 0.5 mm.

5. A vane as claimed in claim 4 having a reinforcing plate secured to said inner surface of said convex wall to form the thickened portion.

6. A vane as claimed in claim 1 having a reinforcing plate secured to said inner surface of said convex wall to form the thickened portion.

7. A vane as claimed in claim 6 wherein said reinforcing plate is secured by brazing.

8. A vane as claimed in claim 5 wherein said reinforcing plate is shaped so as to extend into and fill the volume formed by the curvature of said trailing edge.

9. A vane as claimed in claim 6 wherein said reinforcing plate is shaped so as to extend into and fill the volume formed by the curvature of said trailing edge.

10. A vane as claimed in claim 5 wherein said reinforcing plate is secured by brazing.

11. A vane as claimed in claim 1 being in the form of an aerofoil.

* * * * *